US011098977B2

(12) United States Patent
Cherry et al.

(10) Patent No.: US 11,098,977 B2
(45) Date of Patent: Aug. 24, 2021

(54) HYPERSONIC PNEUMATIC GUN

(71) Applicant: Smartplugs Corporation, Sandpoint, ID (US)

(72) Inventors: Mark Alan Cherry, Sagle, ID (US); Robert Allen Alderman, Sagle, ID (US)

(73) Assignee: SMARTPLUGS CORPORATION, Sandpoint, ID (US)

( * ) Notice: Subject to any disclaimer, the term of this patent is extended or adjusted under 35 U.S.C. 154(b) by 0 days.

(21) Appl. No.: 16/417,064

(22) Filed: May 20, 2019

(65) Prior Publication Data

US 2020/0025511 A1 Jan. 23, 2020

Related U.S. Application Data

(60) Provisional application No. 62/674,306, filed on May 21, 2018.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/62; F41B 11/72; F41B 11/723
See application file for complete search history.

(56) References Cited

U.S. PATENT DOCUMENTS 3,542,008 A * 11/1970 Joslyn ..... F41B 11/62 124/76
4,148,245 A * 4/1979 Steffanus ..... F41A 1/04 89/7
4,658,699 A * 4/1987 Dahm ..... F42B 5/16 102/440
5,813,392 A * 9/1998 McCaslin ..... F41B 11/723 124/73
6,089,139 A * 7/2000 Russell ..... F41A 1/00 89/14.05
7,086,393 B1 * 8/2006 Moss ..... F41B 11/62 124/70
8,322,329 B1 * 12/2012 Sikes ..... F41B 11/724 124/73
9,222,737 B1 * 12/2015 Lund ..... F41A 1/04
(Continued)

OTHER PUBLICATIONS

The PCT Search Report and Written Opinion dated Jul. 26, 2019 for PCT Application No. PCT/US2019/033106, 8 pages.

*Primary Examiner* — Gabriel J. Klein

(57) ABSTRACT

A pneumatic gun designed to provide uniform, constant acceleration to a projectile which includes a gas storage tank designed to store a blend of gases under pressure. The pneumatic gun also includes a buttstock that includes a pre-chamber storage vessel in fluid communication with the storage tank. The pneumatic gun further includes a sleeve valve in fluid communication with the pre-chamber storage vessel and designed to control flow of the blend of gases from the pre-chamber storage vessel into a nozzle located adjacent the sleeve valve. The nozzle is shaped to accelerate a velocity of the blend of gases across an axial length of the nozzle. The pneumatic gun also includes a trigger that is designed to open the sleeve valve when the trigger is actuated such that the sleeve valve remains open until a projectile exits a barrel of the pneumatic gun.

13 Claims, 9 Drawing Sheets

(56) References Cited

U.S. PATENT DOCUMENTS

| | | | | |
|---|---|---|---|---|
| 2002/0100361 | A1 | 8/2002 | Russell | |
| 2003/0116189 | A1* | 6/2003 | Liang | F16K 3/265 137/68.23 |
| 2003/0145840 | A1* | 8/2003 | Sanford | F42B 12/745 124/74 |
| 2005/0188979 | A1 | 9/2005 | Berry | |
| 2011/0113539 | A1 | 5/2011 | Appleton | |
| 2011/0290227 | A1* | 12/2011 | Williford | F41B 11/68 124/56 |
| 2015/0090243 | A1* | 4/2015 | Tseng | F17C 13/084 124/74 |
| 2016/0161212 | A1 | 6/2016 | Bergeron | |
| 2016/0245615 | A1* | 8/2016 | Harvey | F41C 23/22 |
| 2016/0363413 | A1 | 12/2016 | Marshall | |

* cited by examiner

HYPERSONIC PNEUMATIC GUN

CROSS REFERENCE TO RELATED PATENT APPLICATIONS

The present application claims priority to U.S. Provisional Application Ser. No. 62/674,306, filed on May 21, 2018, entitled "Hypersonic Pneumatic Gun A.K.A. Constant Acceleration Pneumatic gun. (C.A.P.)," the entirety of which, is incorporated herein by reference.

BACKGROUND

Traditional air guns offer unique advantages compared to most firearms. For example, low energy air guns may require less space for operation, are significantly quieter than firearms that utilize combustion to propel a projectile, do not require combustion gas ventilation for indoor shooting, may require much cheaper ammunition, and are growing in the versatility of caliber and energy that are provided. Described herein are improvements and technological advances that, among other things, significantly advance the performance of air guns. Traditional air guns cannot compete with firearms in performance and velocity. This CAP technology enables non-firearm pneumatic guns to compete with firearms.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the components on a larger scale or differently shaped for the sake of clarity.

DETAILED DESCRIPTION

Figure 1:
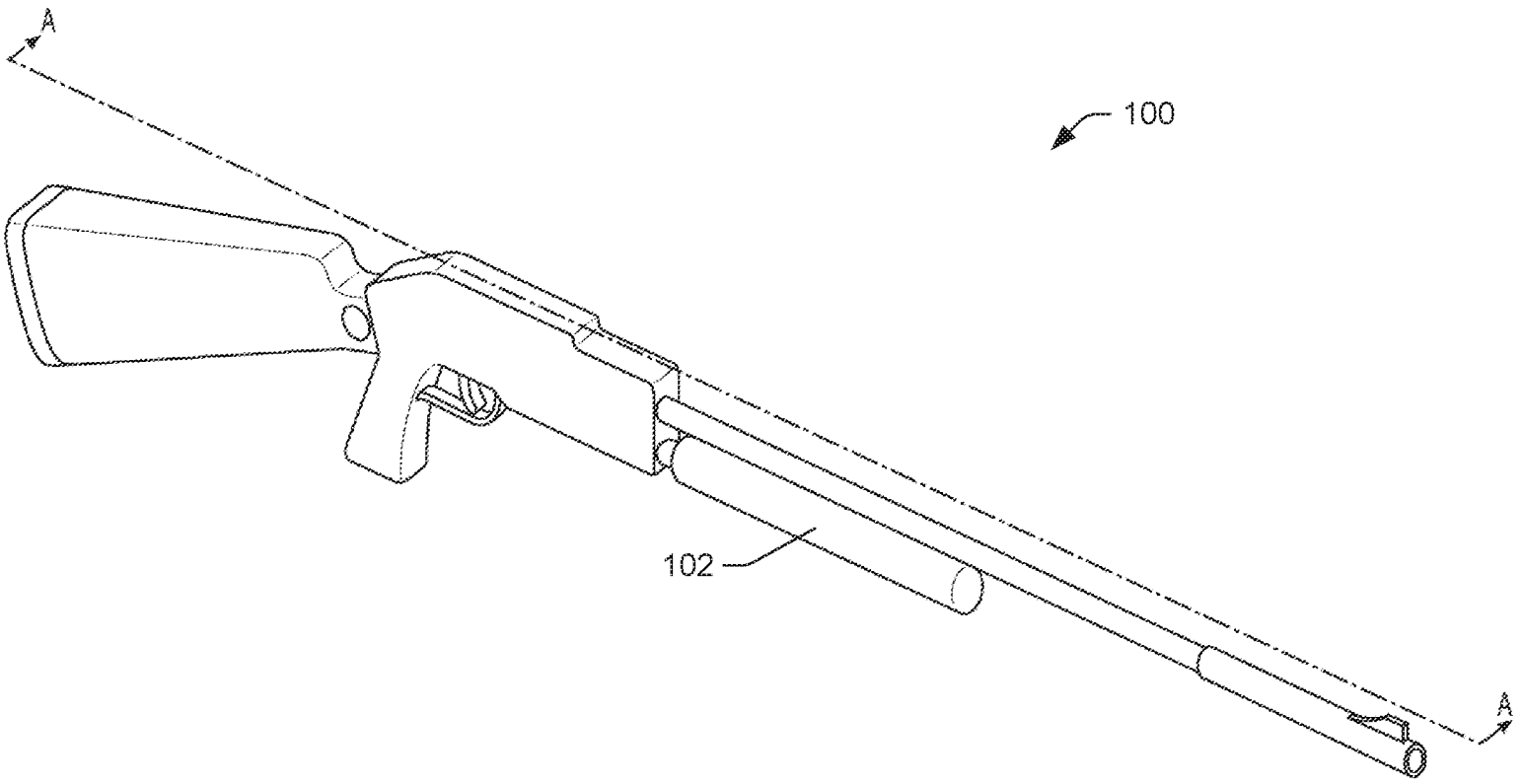
FIG. 1 illustrates a perspective view of an example hypersonic pneumatic gun.

As described previously, current air guns (or "pneumatic guns") provide certain advantages over traditional firearms because they may be used in spaces that firearms may not be used (i.e., indoors, a backyard, etc.), may be significantly quieter than firearms (and they may legally use a silencer or suppressor), and typically require cheaper ammunition. However, while current air guns are offered in a variety of different calibers and max pressure capabilities, air guns are limited in velocity by the speed of sound of the gas propelling the projectile (e.g., a bullet) from the gun. This limitation stems from the speed of sound in a gas given by the following equation:

$$v_{sound\ in\ gas} = \sqrt{\frac{\gamma * R * T}{M}}$$

where v is the speed of sound in a gas, γ is the adiabatic constant, R is the universal gas constant, T is the absolute temperature, and M is the molecular weight of the given gas. As shown by the equation above, the molecular weight of the gas is a significant influence the speed of sound. In addition, the temperature of a specific gas provides another major factor that influences the speed of sound in a gas. Using pure air, current state-of-the-art air guns using pure air reach maximum velocities of approximately 1,000 to 1,100 feet per second (fps). Mechanical spring or gas spring air guns can achieve slightly higher velocities by two mechanisms described further herein below.

One mechanism is heat of compression. In a mechanical spring air gun, the spring rapidly compresses the gas (in this example pure air) and raises the ambient temperature of the air. The increased temperature raises the speed of sound associated with the air due to the rapid increase in temperature and as shown by the above equation. This allows some smaller caliber air guns to reach muzzle velocities from approximately 1,200 to 1,300 fps, just above the 1,100 fps barrier speed of sound for ambient air.

The other mechanism that may be implemented is compression ignition or diesel-like combustion, which results from the above described heat of compression. For example, some air guns may come from the factory with machine oils or lubricants present in gun or may be added by an end user. These hydrocarbon fuels in the hot air environment of rapid compression described above can ignite and combust due to heat in a chamber of the gun exceeding the fuel's self-ignition temperature. Several gas piston/spring driven small caliber guns advertise approximately 1,400 to 1,600 fps due to the machine oils and/or lubricants present in the gun from the factory. However, testing shows that once these oils and/or lubricants are consumed by repeated operation of the gun, the velocities drop back to near the speed of sound associated with pure air.

Furthermore, in pre-charged pneumatic (PCP) guns, the propellant gas for these guns has been previously compressed and stored in a high-pressure storage tank; therefore, the heat of compression described previously may not be available and diesel combustion may not be achieved. Therefore, most PCP guns are limited to 900 to 1,100 fps, regardless of how high the pressure is in the storage tank.

It is important to note that a shock wave between the high-pressure gas and the projectile from the air gun causes a very large pressure drop across the shock wave such that a gas compressed to about 1,000 pounds per square inch (psi), 4,500 psi, or even 10,000 psi result in the same speed of sound limited velocity. Therefore, the velocity of the projectile remains limited by the speed of sound of the gas propellant regardless of the pressure available behind the shock wave. In examples, traditional air guns are a factor of 10 lower performance than firearms of the same caliber. The presently disclosed technology erases that performance deficit—even enabling air guns to exceed firearm performance in some examples.

Disclosed herein are example pneumatic guns and/or projectiles that overcome the deficiencies and/or limitations described above. The fundamental concept involves developing a constant force behind the projectile for the full length of the barrel. A constant force on a constant mass of the projectile results in Constant Acceleration. Typical air guns do not do this. In fact, typical firearms do not do this. State of the art air guns and firearms charge the breech with high pressure and then allow normal gas expansion to occur as the volume behind the bullet increases. The mechanism in this technology enables the stored gas pressure to be released in such a way as to raise the force from zero to a maximum target pressure in an almost instantaneous way. Then maintain this pressure nearly constant for the duration of the bullet's transit in the barrel. Our technology provides a mechanism to rapidly open the valve and then keep it open for the finite time of bullet transit in the barrel, closing the valve shortly before the bullet leave the barrel. Additionally, conventional propellants such as air, nitrogen or carbon dioxide cannot maintain this constant pressure beyond the speed of sound in those gases due to the pressure drop across a shockwave. In examples, a pneumatic gun may include a main pressure storage tank that stores a gas and/or a blend of gases under pressure. Additionally, and/or alternatively, the pneumatic gun may not include the main pressure storage tank as part of the pneumatic gun, but may optionally be in fluid communication with a gas storage vessel that is separate from the pneumatic gun. The pneumatic gun may also include a pre-chamber storage vessel that is in fluid communication with the main pressure storage tank. The pre-chamber storage vessel may store a specific volume of gas at a predetermined pressure such that the pneumatic gun is able to apply a substantially constant pressure behind a projectile down an entire length of a barrel of the pneumatic gun, thereby resulting in constant acceleration of the projectile down the entire length of the barrel. It should be understood that when "in fluid communication" is used in this disclosure, that phrase is meant to articulate that gas and/or liquid may be caused to travel and/or flow from one element to another element.

The pneumatic gun may also include a valve that is configured to control a flow of gas from the pre-chamber storage vessel. In examples, the valve may be configured to deliver substantially instantaneous pressure to a projectile and maintain said pressure on the projectile as the projectile travels down an entire length of a barrel of the pneumatic gun. That is to say, the valve may be configured to open based at least in part on actuation of a trigger and to remain at least partially open until at least a portion of the projectile has exited the barrel and/or an inch or two prior to the projectile reaching the end of the barrel. In examples, the valve may include an ultra-low inertia valve that is able to open completely in microsecond(s). Additionally, and/or alternatively, the valve may further include a large minimally restrictive valve area such that gas flow is not choked in the valve, (choked flow is defined as anytime the pressure ratio across a given orifice exceeds 2:1 or when the speed of sound for that gas is reached in said orifice) where the gas may reach its speed of sound in the valve rather than in the bore of the gun. Therefore, in examples, any and/or all passageways in the pneumatic gun may include a minimum area that is approximately two times greater than the area of the rifle bore. Such an arrangement may assure that choked flow does not occur anywhere in the pneumatic gun prior to the bore of the barrel. In examples, the valve may include a lightweight and/or high-strength material. Additionally, and/or alternatively, the valve may include a sleeve valve. The sleeve valve may cancel the high pressure gas force typically holding a poppet style valve closed. High forces generated by high pressure gas in typical air guns may make it difficult to open the valve with the typical springs and hammers used in typical air guns. The sleeve valve inherently includes equal and opposite pressures acting on all sides of the valve, such that these forces cancel each other out. Therefore, the force necessary to open the sleeve valve is adequate force to overcome the inertia of the valve itself. This cancelation of high gas pressure forces and the low inertia of the sleeve valve enable light weight springs and hammers to rapidly control extremely high gas pressures with low energy input.

In examples, the pneumatic gun may further include a nozzle disposed adjacent to the valve and between the valve and the barrel. The nozzle may be shaped to accelerate a velocity of the gas across an axial length of the nozzle. The nozzle may be configured to introduce the gas(es) into the breech of the barrel at a high velocity. In examples, the barrel (or a breech of the barrel) may be shaped and/or configured to accommodate a projectile in such a way that the barrel maintains a substantially stationary position of the projectile until a threshold pressure has been achieved in the breech proximate a rear portion of the projectile. In other words, the breech of the pneumatic gun may be configured to prevent movement of the projectile until a threshold pressure has been reached in the breech and/or the nozzle. In examples, the threshold pressure may be between approximately 75% and approximately 98% of a pressure of gas contained in the pre-chamber storage vessel. Once the threshold pressure has been reached, the projectile may be released to accelerate down the barrel.

In examples, the pneumatic gun described herein may be capable of breaking the typical speed of sound barriers described previously. For example, the pneumatic gun described herein may be capable of launching a projectile in the range of approximately 3,000 fps to approximately 4,000 fps. This increased speed of sound results in increased muzzle energy and muzzle velocities of various caliber projectiles.

Additional details of these and other examples are described below with reference to the drawings.

FIG. 1 depicts a perspective view of a pneumatic gun 100. In examples, the pneumatic gun 100 may include a pre-charged pneumatic (PCP) gun. However, in examples, the pneumatic gun 100 may include other types of air guns. As shown in FIG. 1, the pneumatic gun 100 may include a main gas storage tank 102. The main gas storage tank 102 may include a high-pressure cylinder that is configured to store a gas and/or a blend of gases under pressure. In examples, the main gas storage tank 102 may include any material capable of storing a gas (and/or other fluids) under high pressures (i.e., greater than atmospheric pressure). The pneumatic gun 100 may be configured to utilize the gas stored in the main gas storage tank 102 as a propellant for propelling a projectile out of the pneumatic gun 100. In examples, the main gas storage tank 102 may store a blend of gases that is light (i.e., gases that may be air). For example, the pneumatic gun 100 may use a blend of gases including, but not limited to, at least one of hydrogen, helium, and a gaseous flame retardant. In examples, the gaseous flame retardant may comprise up to approximately 10% of the gas blend. Additionally, and/or alternatively, the gaseous flame retardant, which may be utilized when usingflammable gases such as hydrogen, may comprise more than 10% or less than 10% of the blend of gases. In examples, such a blend of gases may include a molar mass that is less than air (i.e., the blend of gases may include a molar mass that is equal to or less than 28.97 g/mol). For example, the blend of gases may include a molar mass that is between approximately 2 g/mol and approximately 25 g/mol.

The gaseous flame retardant may allow the blend of gases to include a higher percentage of hydrogen and/or helium while mitigating some and/or all of the flammability risk due to the increased hydrogen content of the blend of gases. The gaseous flame retardant may behave in such a way that the gaseous flame retardant becomes active when pressure and temperature conditions are reached for combustion. The increased composition of hydrogen and/or helium in the blend of gases may increase the speed of sound capable in the propellant used in the pneumatic gun 100. In examples, the speed of sound associated with the gas and/or blend of gases may be between approximately 1,000 feet per second (fps) and approximately 6,000 fps, between approximately 2,000 fps and approximately 5,000 fps, between approximately 2,500 fps and approximately 4,500 fps, and/or between approximately 3,000 fps and approximately 4,000 fps at approximately ambient temperature. In examples, the blend of gases may further include a lubricant. For example, the blend of gases may include a lubricant that has a high flashpoint and/or a lubricant that is non-flammable. Such lubricant may include a silicone oil, organic, or synthetic-based lubricants, etc.

Figure 2:
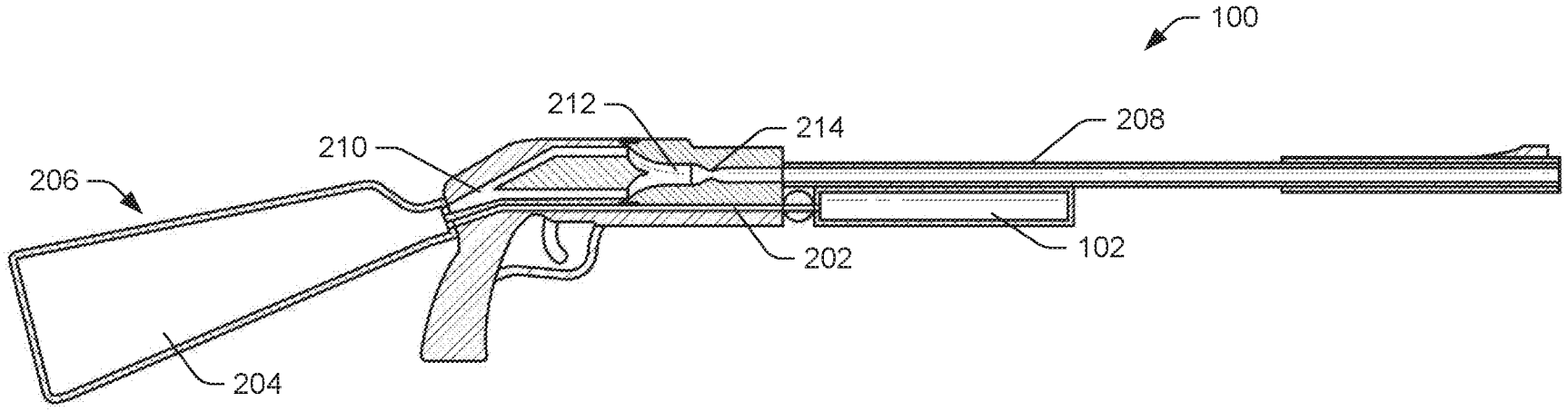
FIG. 2 illustrates a cross-sectional view of the hypersonic pneumatic gun taken along line A-A in FIG. 1.

FIG. 2 illustrates a cross-sectional view of the hypersonic pneumatic gun taken along line A-A in FIG. 1. As shown in FIG. 2, the pneumatic gun 100 may include a first flow line 202 (otherwise described as a "flow channel") from the main gas storage 102 to a pre-chamber storage vessel 204 (otherwise described as a "pre-chamber storage tank"). The flow line 202 may provide fluid communication between the main pressure storage tank 102 and the pre-chamber storage vessel 204 such that gas is able to flow from the main pressure storage tank 102 to the pre-chamber storage vessel 204. In examples, the pneumatic gun 100 may include a valve (not shown) to control the flow of gas from the main pressure storage tank 102 and the pre-chamber storage vessel 204.

As mentioned previously, the pneumatic gun 100 may include a pre-chamber storage vessel 204. In examples, the pre-chamber storage vessel 204 may be located in a stock 206 of the pneumatic gun 100. Additionally, and/or alternatively, the pre-chamber storage vessel 204 may be configured as part of the buttstock of the pneumatic gun 100. The pre-chamber storage vessel 204 may include a volume that is approximately ten times greater than a bore volume of a barrel 208 of the rifle. Additionally, and/or alternatively, the pre-chamber storage vessel 204 may include a volume that is between approximately five times to approximately fifteen times greater than the bore volume of the barrel 208. Furthermore, the pre-chamber storage vessel 204 may be configured to store the gas and/or blend of gases at a predetermined pressure. For example, the pre-chamber storage vessel 204 may be configured to store a specific volume of the gas and/or blend of gases at the predetermined pressure that will then propel a projectile out of the barrel 208 of the pneumatic gun 100. In examples, the greater volume in the pre-chamber storage vessel 204 enables the pneumatic gun 100 to maintain a substantially constant pressure behind a projectile as it travels down the barrel 208 of the pneumatic gun 100. As used herein, the substantially constant pressure may include a pressure between about 75% to about 100% of the maximum pressure held in the pre-chamber storage vessel 204.

As shown in FIG. 2, the pneumatic gun 100 may include a second flow line 210 from the pre-chamber storage vessel 204 to a valve 212. The valve 212 may be configured to control the flow of gas and/or gases from the pre-chamber storage vessel 204. In examples, the valve 212 may include a sleeve valve. Additionally, and/or alternatively, the valve 212 may include an annular sleeve valve. However, the pneumatic gun 100 may include any type of valve to control flow of gas from the pre-chamber storage vessel 204. Additionally, and/or alternatively, the valve 212 may include lightweight, high-strength materials. For example, the valve 212 may comprise a titanium valve. As mentioned previously, the valve 212 may include an ultra-low inertia valve, enabling the pneumatic gun 100 to deliver substantially instantaneous pressure to a projectile. In examples, the valve 212 may be configured to open and remain open until a predetermined time has elapsed. For example, the valve 212 may be configured to remain open until at least a portion of the projectile exits the barrel 208 of the pneumatic gun 100. In other words, upon a control mechanism (such as a trigger or other mechanism) being actuated, the valve 212 may rapidly open (e.g., in microsecond(s)) and remain open until the projectile has at least partially exited the barrel 208. Furthermore, the valve 212 may include a large, minimally-restrictive valve area (greater than or equal to approximately a 2:1 area ratio) to prevent choked gas flow in the valve. For example, the valve 212 may include an opening that has a cross-sectional area that is at least two times greater than a cross-sectional area of the projectile and/or barrel.

The pneumatic gun 100 may further include a nozzle 214 disposed adjacent to and/or at an opening of the valve 212. The nozzle 214 may be shaped to accelerate a velocity of the gas across an axial length of the nozzle 214. That is to say, the nozzle 214 may be shaped to promote flow of the gas toward a center axis of the nozzle. In examples, the nozzle 214 may include a de Laval shaped nozzle. Additionally, and/or alternatively, the pneumatic gun 100 may include any type of nozzle configured to accelerate the gas from the valve 212 into the barrel 208 of the pneumatic gun 100. Optionally, the pneumatic gun 100 may omit the nozzle 214 in examples. In examples, the nozzle 214 may be disposed between the valve 212 and the barrel 208 of the pneumatic gun 100. The barrel 208 may include a first end and a second end, the first end being disposed adjacent to the nozzle 214 such that the first end of the barrel 208 abuts an opening of the nozzle 214. In examples, the barrel 208 may be shaped to hold a projectile until at least a threshold pressure is applied to the projectile from gas(es) flowing through the nozzle 214. For example, the barrel 208 may be configured to hold a position of the projectile until at least approximately 90% of the pre-chamber storage vessel pressure is reached behind the projectile. This feature will be described further herein below with respect to FIGS. 4A-4C. In examples, the barrel 208 is rifled to spin the projectile, thus increasing the accuracy of the projectile fired from the pneumatic gun 100.

Figure 3:
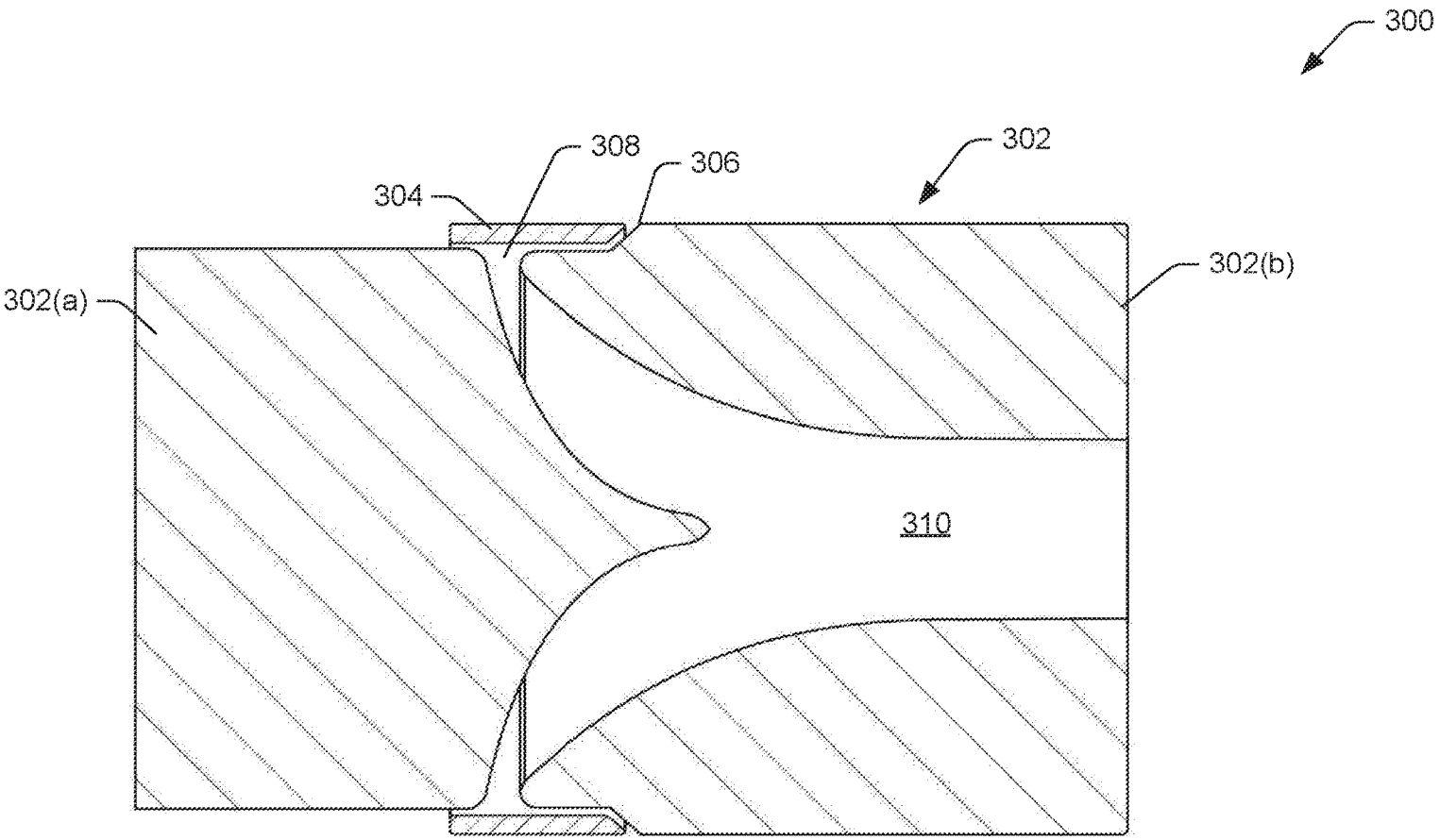
FIG. 3 illustrates a cross-sectional view of an example valve of an example hypersonic pneumatic gun.

FIG. 3 depicts a cross-sectional view of an example valve 300 of the pneumatic gun 100 described in FIGS. 1 and 2. The valve 300 may have the same or similar features and/or functionalities as the valve 212 described with respect to FIG. 2. As mentioned previously, the valve 300 may include a sleeve valve. Specifically, the valve 300 may include an annular slot sleeve valve. As shown in FIG. 3, the valve 300 may include a body 302 including a first portion 302(*a*) having a first diameter and a second portion 302(*b*) having a second diameter. The first portion 302(*a*) may be shaped to receive a sleeve 304 that fits over at least a portion of the first portion. As shown in FIG. 3, the second portion 302(*b*) may be shaped to prevent the sleeve 304 from sliding over the bevel 306. In examples, the flow of gas from the second flow line may reach an adequate pressure to push the sleeve 304 up a portion of the bevel 306, but not over the bevel 306. When this happens, the sleeve 304 may expand and/or move and allow gas to flow through the annular slot 308 and into the valve channel 310. Additionally, and/or alternatively, the sleeve 304 may be moved partially up the bevel 306 by other mechanical and/or electrical devices such as a solenoid and/or other actuator. As mentioned previously, the sleeve valve may require less force to open than a typical poppet valve due to the equal and opposite forces acting on all sides of the sleeve, thereby canceling out the forces acting on the sleeve. Therefore, the maximum force necessary to open the sleeve valve is adequate force to overcome the inertia of the sleeve itself.

Figure 4A:
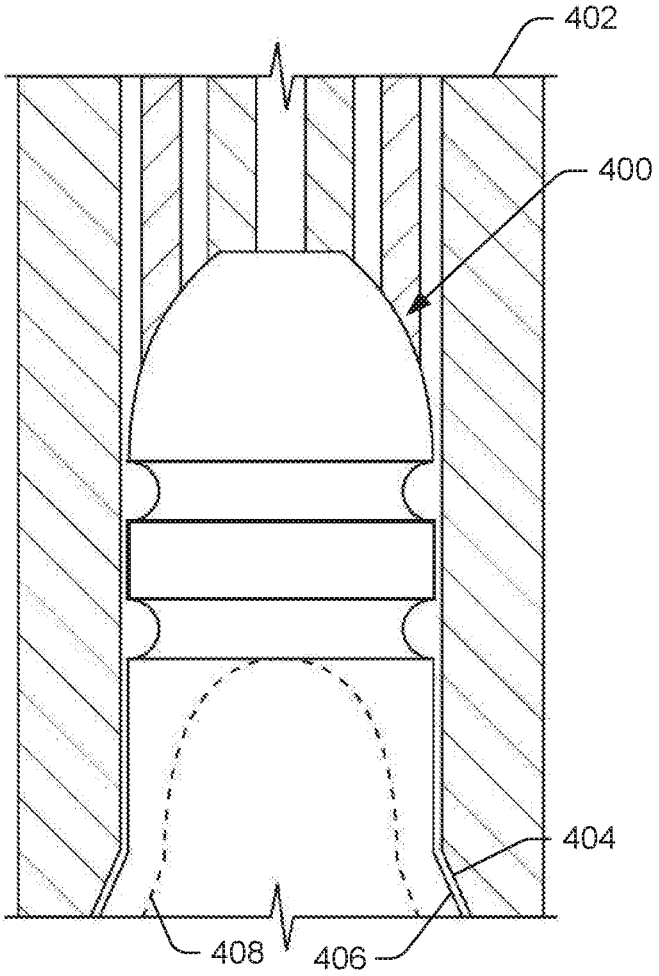
FIG. 4A illustrates a first example of a projectile used in conjunction with a hypersonic pneumatic gun.

FIG. 4A depicts an example projectile 400 that may be fired from a pneumatic gun, such as the pneumatic gun 100 described with respect to FIGS. 1 and 2. As mentioned previously and as shown in FIG. 4A, the barrel 402 (or a breech of the barrel) of the pneumatic gun may be shaped to receive a projectile 400 in such a way that the barrel 402 maintains a substantially stationary position of the projectile 400 until at least a threshold pressure has been achieved in the barrel 402 proximate a rear portion of the projectile 400. As shown in FIG. 4A, the barrel 402 may include a tapered portion 404 such that the barrel includes a first portion having a first inside diameter and a second portion (the tapered portion 406) having a second inside diameter that is greater than the first inside diameter. The barrel 402 may include a gradual taper between the first diameter to the second diameter. The tapered portion 404 may include any length of a portion of the barrel 402. Additionally, and/or alternatively, the tapered portion 404 may be included in a breech (not shown) of the barrel 402.

The tapered portion 404 of the barrel 402 may be shaped to correspond with a shape of a flared portion 406 of the projectile 400. In examples, the projectile 400 may include a proximal (or "flared portion 406") end with a first diameter and a distal end with a second diameter, the first diameter being greater than the second diameter, as shown in FIG. 4A. In examples, the flared portion 406 of the projectile 400 may be configured to correspond with the tapered portion 404 of the barrel 402 so as to prevent movement of the projectile until a threshold pressure has been achieved behind the projectile 400 and/or in a cone 408 (a recessed region) of the projectile 400. Once the threshold pressure has been met and/or exceeded the pressure of gas behind the projectile may overcome the force of the flared portion 406 preventing movement of the projectile. In such an example, the tapered portion 404 of the barrel 402 may crimp and/or bend the flared portion 406 of the projectile 400 so as to allow the projectile 400 to travel down the barrel 402 of the pneumatic gun. In examples, the projectile 400 may be extruded by the forces acting on it such as the gas(es) forcing the projectile 400 down the barrel 402 and the barrel 402 pushing against the projectile 400.

Figure 4B:
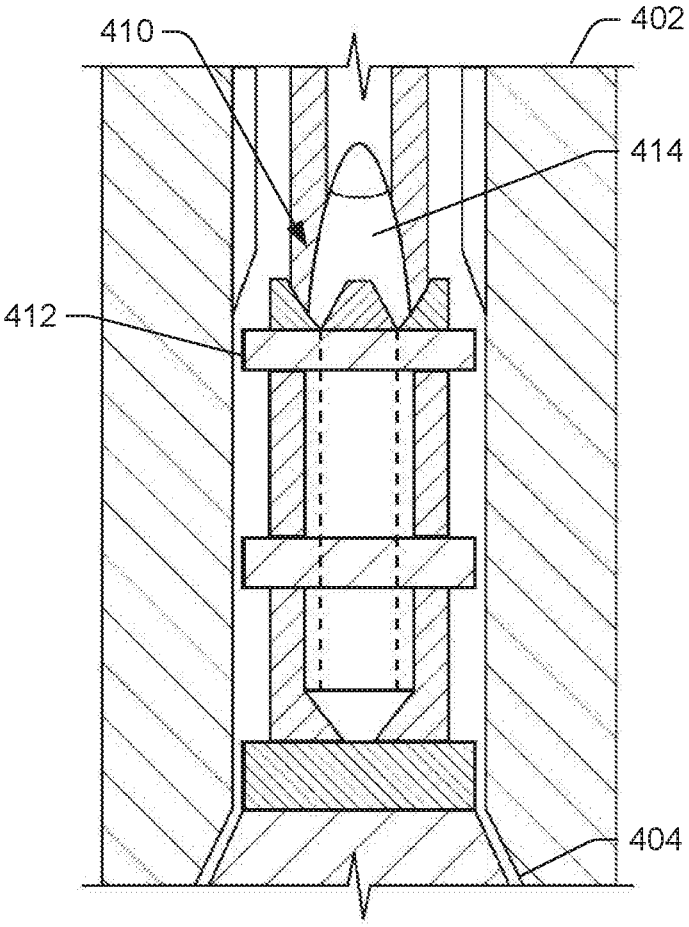
FIG. 4B illustrates a second example of a projectile used in conjunction with a hypersonic pneumatic gun.

FIG. 4B depicts another example projectile 410 that may be fired from a pneumatic gun, such as the pneumatic gun 100 described with respect to FIGS. 1 and 2. As described previously, the barrel 402 of the pneumatic gun may include a tapered portion 404. The tapered portion 404 of the barrel 402 may correspond with a sabot 412 that carries the bullet (or pellet) 414. Similar to FIG. 4A, the tapered portion 404 of the barrel 402 may maintain a substantially stationary portion of the projectile 410 until at least a threshold pressure has been achieved behind the projectile 410. Once the threshold pressure has been achieved, the tapered portion 404 of the barrel 402 may crimp and/or bend the sabot 412 such that the projectile 410 is able to travel down the barrel 402. In examples, the sabot 412 may travel with the bullet 414 until it reaches the intended target. However, in examples, the sabot 412 may separate from the bullet 414 prior to reaching the intended target and/or after a certain distance from exiting the barrel 402. In examples, a sabot 412 may be used in a pneumatic gun that has a larger bore diameter than the bullet 414 (often referred to as a sub-caliber projectile) that is to be fired from the gun. In such an example, the sabot 412 makes fills an entire bore area between an intentionally designed sub-caliber projectile and the barrel. This results in providing a larger surface area for propellant gases to act upon than just the base of the projectile.

Figure 4C:
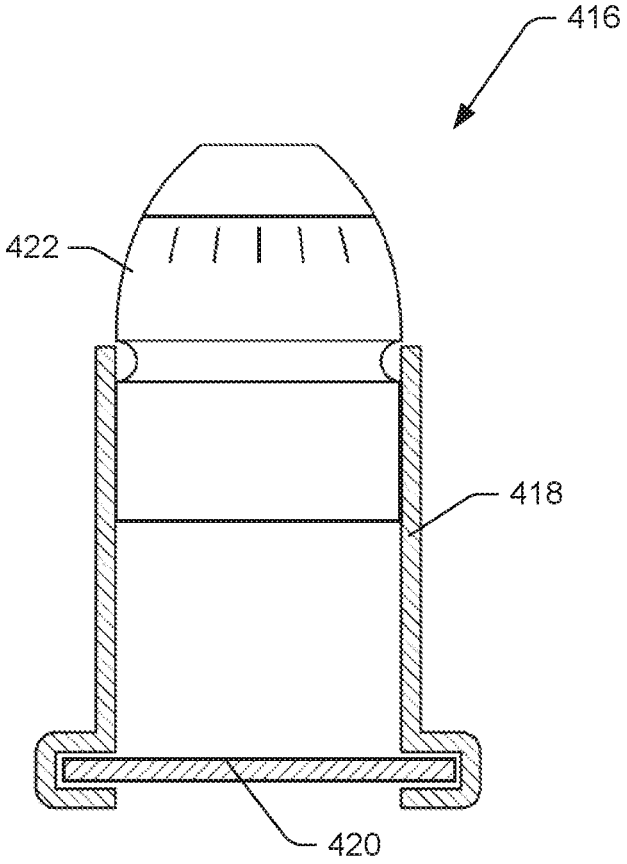
FIG. 4C illustrates a third example of a projectile that is used in conjunction with a hypersonic pneumatic gun.

FIG. 4C depicts another examples projectile 416 that may be fired from a pneumatic gun, such as the pneumatic gun 100 described with respect to FIGS. 1 and 2. As mentioned previously, the barrel of the pneumatic gun may include a first portion having a first inside diameter and a second portion having a second inside diameter that is greater than the first inside diameter. This second portion may be configured to maintain a substantially stationary position of the projectile 416 until a threshold pressure has been achieved behind the projectile. This may be accomplished by a case 418 of the projectile 416 contacting and pushing against the second portion of the barrel. In the example shown in FIG. 4C, once the threshold pressure has been achieved, a burst disk 420 may rupture, thus allowing the pressurized gas to reach the bullet 422 and to propel the bullet 422 down the barrel of the pneumatic gun. In examples, the burst disk 420 may be designed to withstand a specific amount of force, thereby rupturing at a substantially consistent pressure. For example, the burst disk 420 may include specially designed scores, lines, thin walls, and/or etching that promotes breakage at a specified pressure. It is important to note that each of the projectiles shown in FIGS. 4A-4C may be designed to withstand a threshold amount of pressure in order to release the bullet and/or projectile once a specific pressure has been reached behind the projectile. Such a design may enable the pneumatic gun to fire a consistent shot each time.

Figure 5:
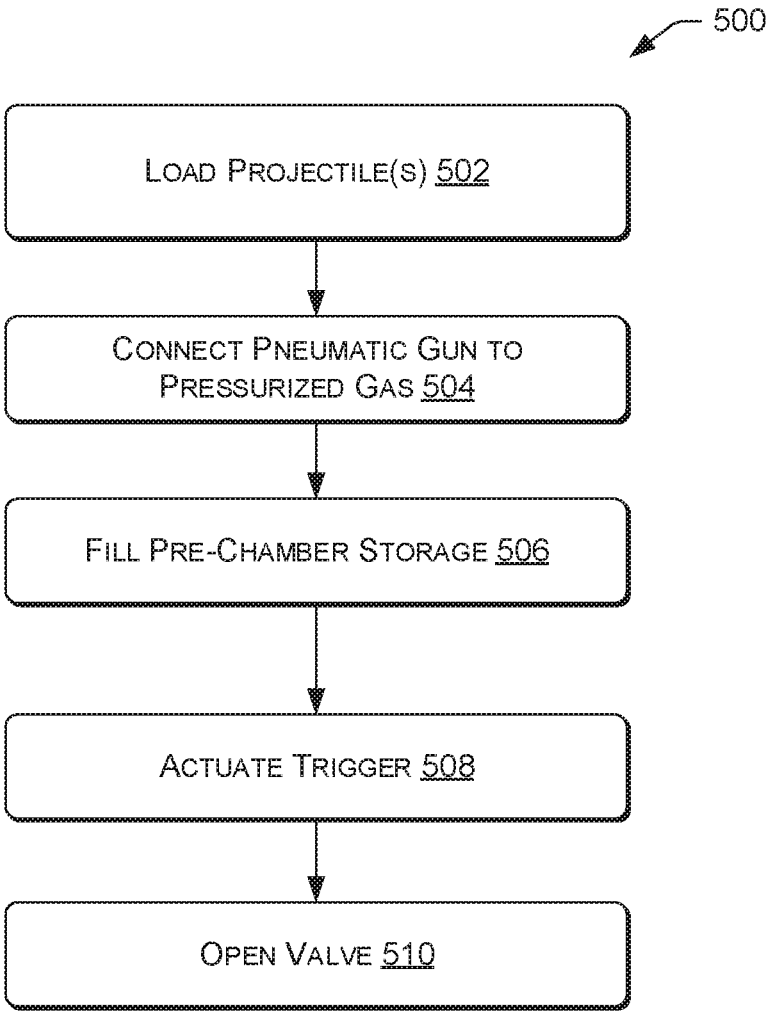
FIG. 5 is a flowchart illustrating an example process of using a hypersonic pneumatic gun.

FIG. 5 illustrates processes of utilizing a pneumatic gun. The processes described herein are illustrated as collections of blocks in logical flow diagrams, which represent a sequence of operations, some or all of which may be implemented by elements of a pneumatic gun. The order in which the blocks are described should not be construed as a limitation, unless specifically noted. Any number of the described blocks may be combined in any order and/or in parallel to implement the process, or alternative processes, and not all of the blocks need be executed. For discussion purposes, the processes are described with reference to the devices described in the examples herein, such as, for example those described with respect to FIGS. 1-4C, although the processes may be implemented in a wide variety of other environments and with other devices.

FIG. 5 illustrates a flow diagram of an example process 500 of utilizing a pneumatic gun. The order in which the operations are described is not intended to be construed as a limitation, and any number of the described operations can be combined in any order and/or in parallel to implement the process 500.

At 502, the process 500 may include loading one or more projectiles into the pneumatic gun. In examples, the pneumatic gun may be configured to receive and load a single projectile at a time. Additionally, and/or alternatively, the pneumatic gun may be configured to receive and load multiple projectiles at a time. For example, the pneumatic gun may include an ammunition clip that holds multiple projectiles. Additionally, and/or alternatively, the pneumatic gun may include a magazine tube and/or other The pneumatic gun may be configured to receive one or more of the projectiles described in FIGS. 4A-4C. Additionally, and/or alternatively, the pneumatic gun may be configured such that it is able to receive any one of the projectiles in described in FIGS. 4A-4C without changing configuration of the pneumatic gun. Furthermore, the pneumatic gun may be configured to receive other air gun pellets and/or bullets not specifically described herein.

At 504, the process 500 may include connecting the pneumatic gun to pressurized gas. As mentioned previously, this may include attaching a pressurized gas storage tank to the pneumatic gun (described above as the main gas storage tank). Additionally, and/or alternatively, the pneumatic gun may be connected to other pressurized gas sources. As mentioned previously, the pressurized gas may include a blend of hydrogen, helium, and a gaseous flame retardant. In examples, the gas storage tank may be refillable (or rechargeable) once the pressurized gas has been depleted. Additionally, and/or alternatively, the gas storage tank may be replaced with another gas storage tank.

At 506, the process 500 may include filling the pre-chamber storage vessel. For example, the pressurized gas storage tank may fill the pre-chamber storage vessel via flow lines described previously with respect to FIG. 2. In examples, the pre-chamber storage vessel may be filled to a predetermined pressure after a shot is taken and/or a projectile is shot from the gun. In such an example, the pneumatic gun may include a regulator and/or a valve to control flow of gas from the gas storage tank to the pre-chamber storage vessel. In examples, the pre-chamber storage vessel may be filled manually and/or automatically upon connection of the main gas storage tank. In examples, the pre-chamber storage vessel may be filled manually and/or automatically based at least in response to a shot being taken.

At 508, the process 500 may include actuating a trigger of the pneumatic gun. For example, a trigger (or other control mechanism) of the pneumatic gun may be actuated. In examples, other control mechanisms may be implemented since a pneumatic gun does not require a trigger pull to cause a hammer to hit a firing pin. The pneumatic gun may implement a lever, push button, rotation mechanism, and/or any other control mechanism to fire the pneumatic gun.

At 510, the process 500 may include causing a valve of the pneumatic gun to open. For example, a valve of the pneumatic gun may open allowing the high-pressure gas to pass therethrough. In examples, the trigger (or other control mechanism) may open the valve. Additionally, and/or alternatively, as described previously, the pressure of gases from the pre-chamber storage vessel may open the valve. As used herein, "open" may mean that at least a portion of a sleeve slides toward and over a portion of a bevel such that the opening of the valve is revealed allowing gas(es) to pass therethrough. In examples, the high-pressure gas may pass through the valve, into a nozzle accelerating the gas into a projectile and pushing the projectile out of a barrel of the pneumatic gun. The valve may remain open until at least a portion of the projectile has left the barrel of the pneumatic gun. Additionally, and/or alternatively, the valve may remain open until the projectile reaches a threshold distance from the end of the barrel. For example, the valve may remain open until the projectile is approximately one or two inches from the end of the barrel.

Figure 6:
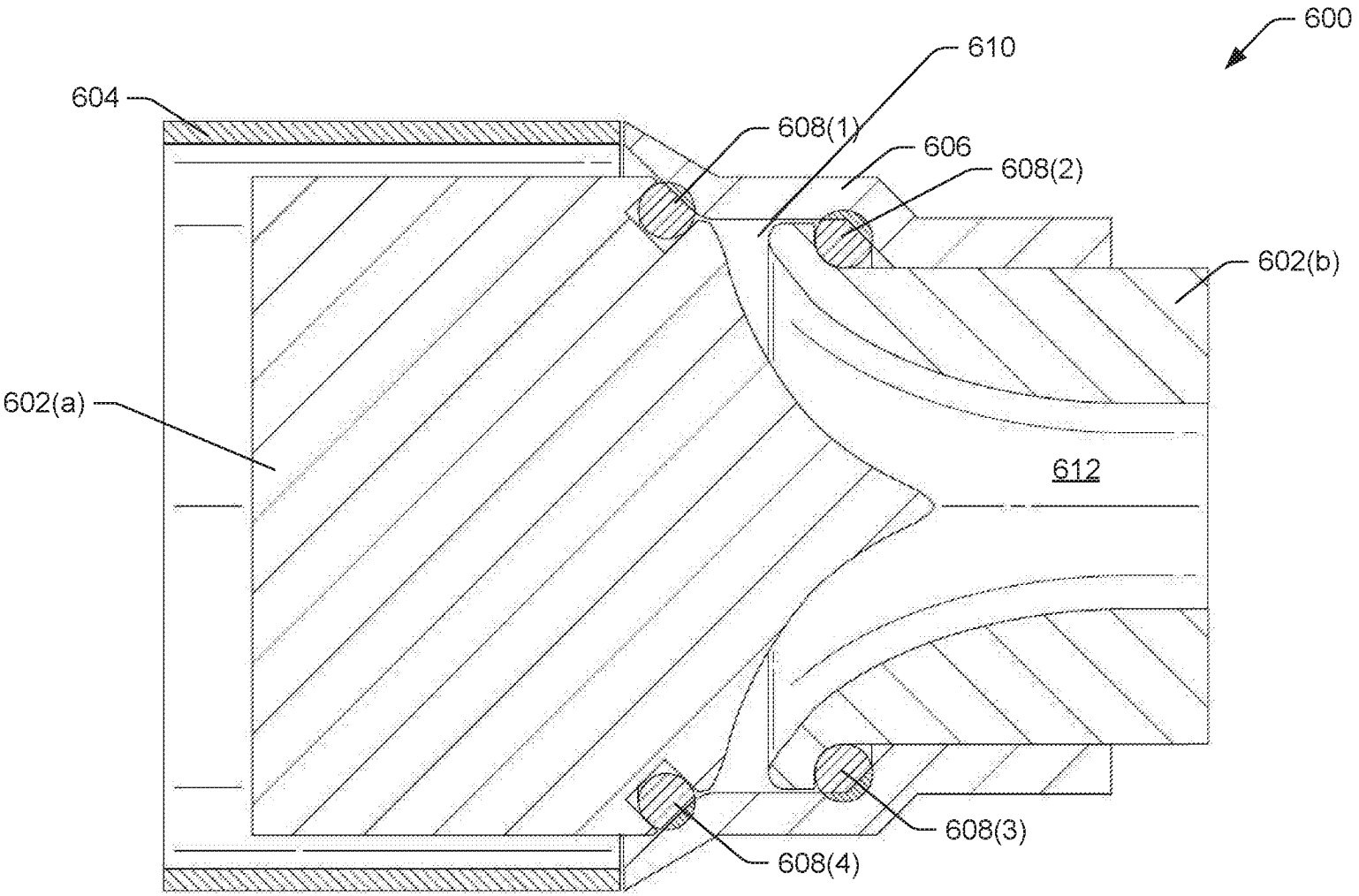
FIG. 6 illustrates a cross-sectional view of an example valve of an example hypersonic pneumatic gun.

FIG. 6 depicts a cross-sectional view of an example valve 600 of the pneumatic gun 100 (as described in the figures above). The valve may include similar features and/or functionalities as the valve 212 described above with respect to FIG. 2. As mentioned previously, the valve 600 may include a sleeve valve. Specifically, the valve 600 may include an annular slot sleeve valve. As shown in FIG. 6, the valve 600 may include a body 602 having a first portion 602(*a*) including a first diameter and a second portion 602(*b*) including a second diameter. The valve may include a transfer tube 604 that is configured to transfer energy from a hammer of the pneumatic gun to the sleeve 606 in order to push the sleeve 606 into an open position so as to allow gas to flow through the valve. The valve 600 may include one or more gaskets 608(1-4) configured to create a gas tight seal when the sleeve 606 is in a closed position (the position shown in FIG. 6). The valve 600 may include an annular slot 610 and a valve channel 612 which may perform similar functions as the valve described in FIG. 3.

Figure 7A:
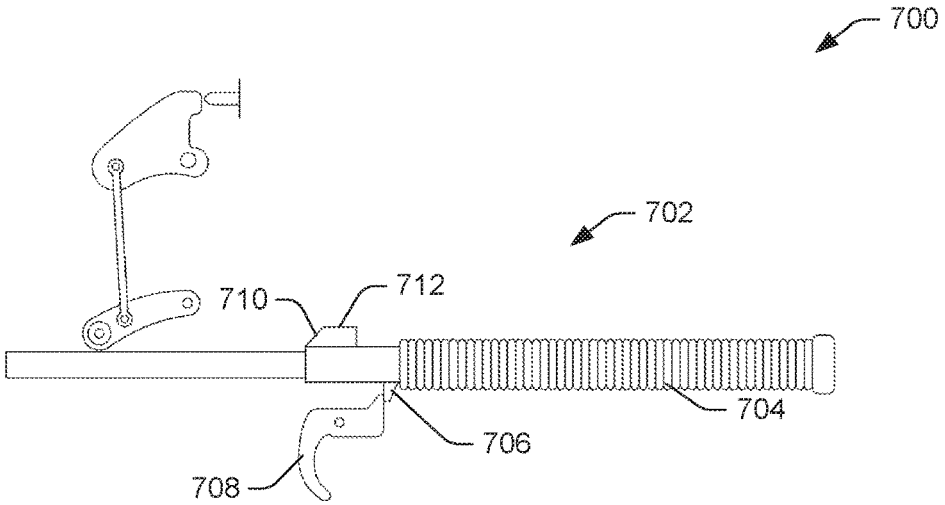
FIG. 7A illustrates an example of a valve control mechanism in a first position.
Figure 7B:
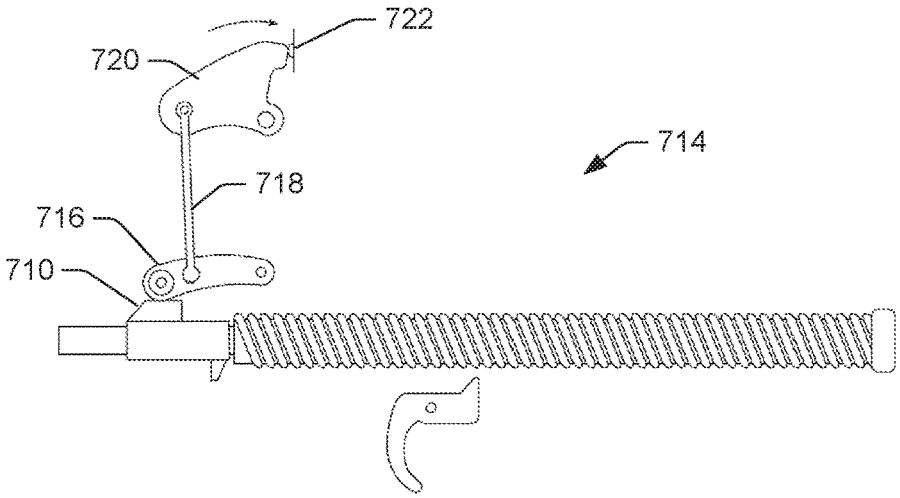
FIG. 7B illustrates an example of a valve control mechanism in a second position.
Figure 7C:
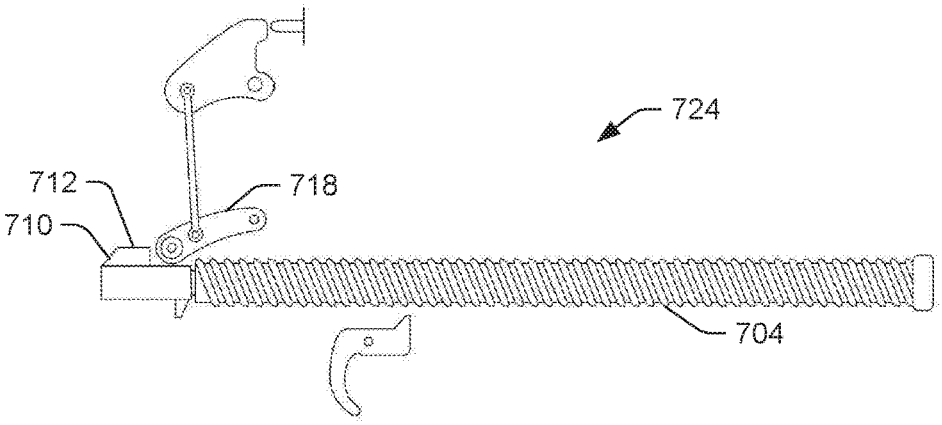
FIG. 7C illustrates an example valve control mechanism in a third position.

FIGS. 7A-7C depict an example valve control mechanism 700 through different steps of opening a valve. The valve described in FIGS. 7A-7C may include a same and/or similar valve as the valves describes in FIGS. 2, 3, and 6 above. FIG. 7A depicts the valve control mechanism 700 in a first position 702. When the valve control mechanism 700 is in the first position 702, a spring 704 may be compressed and held by a tab 706 (also referred to herein as a "sear") that engages trigger 708. The valve control mechanism 700 may include a lift ramp 710 having a plateau 712 thereon.

FIG. 7B depicts the valve control mechanism 700 in a second position 714. In the second position 714, when the trigger 708 is pulled by a user, the spring 704 may release and the lift ramp 710 may engage a roller 716 that is fixed at one point. When the lift ramp 710 engages the roller 716, the roller 716 may lift and move a shaft 718 in a substantially vertical direction. The vertical movement of the shaft 718 may cause a rotating bracket 720 to rotate and engage a valve stem 722. When the rotating bracket 720 engages the valve stem 722, the valve (not pictured) may open. In examples, the plateau 712 may be shaped such that the plateau 712 causes the valve to remain open for a predetermined length of time (i.e., the plateau 712 may keep the valve open as long as the plateau 712 is engaging the roller 716). The predetermined length of time may be adjusted by adjusting the length of the plateau 712. In examples, the plateau 712 may be shaped such that a length of the plateau 712 corresponds to a length of time that a projectile needs to travel a length and/or a portion of the length of a barrel of the pneumatic gun.

FIG. 7C depicts the valve control mechanism 700 in a third position 724. The third position 724 may refer to a position, in which, the spring 704 is fully extended and the lift ramp 710 and plateau 712 have passed by the roller 716. When the plateau 712 disengages the roller 718, the roller will drop vertically, which will cause the valve to close. Once the spring has been extended, the spring 704 may be recompressed to start the valve control process over. In examples, the spring may be manually compressed by a user, or the pneumatic gun may include a mechanism (electric and/or manual) that will recompress the spring 704.*f*

CONCLUSION

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although embodiments have been described in language specific to structural features and/or methodological acts, it is to be understood that the disclosure is not necessarily limited to the specific features or acts described. Rather, the specific features and acts are disclosed herein as illustrative forms of implementing the claimed subject matter.

What is claimed is:

1. A pneumatic gun configured to fire a projectile, comprising:

a multiple vessel, gas storage system configured to store a blend of gases under pressure;

a barrel having a first end and a second end;

a buttstock including a pre-chamber storage vessel aligned with a bore axis of the barrel in fluid communication with a primary gas storage vessel;

an annular slot sleeve valve comprising a first body portion, a second body portion, a sleeve slidably engaged about the second body portion, a first valve seat between the sleeve and the first body portion, and a second valve seat between the sleeve and the second body portion, wherein:

the sleeve is configured to slide along the second body portion from a closed-valve position where the sleeve is seated upon both the first and second valve seats to an open-valve position where the sleeve is unseated from each of the first and second valve seats, and the sleeve valve is in fluid communication with the pre-chamber storage vessel and configured to mechanically control the flow of gases from the pre-chamber storage vessel;

a De Laval nozzle immediately adjacent the sleeve valve and upstream of the barrel, wherein the nozzle is shaped to accelerate the blend of gases to supersonic velocity across an axial length of the nozzle;

the first end of the barrel being disposed adjacent to the nozzle such that the first end of the barrel abuts an opening of the nozzle; and a trigger configured to mechanically open the sleeve valve upon actuation of the trigger, wherein the sleeve valve is configured to remain open until a projectile exits the barrel.

2. The pneumatic gun of claim 1, wherein the blend of gases is light.

3. The pneumatic gun of claim 1, wherein the blend of gases includes helium, hydrogen, and a gaseous flame retardant.

4. The pneumatic gun of claim 1, wherein the sleeve valve includes an opening having a cross-sectional area at least two times greater than a cross-sectional area of the bore of the barrel in order to prevent choked flow.

5. The pneumatic gun of claim 1, wherein the sleeve valve is formed from titanium.

6. The pneumatic gun of claim 1, wherein the pre-chamber storage vessel includes a first volume and the barrel includes a second volume, wherein the first volume is between five times and fifteen times greater than the second volume.

7. The pneumatic gun of claim 1, wherein the blend of gases is associated with a speed of sound between 3 to 4 times the speed of sound in air.

8. A pneumatic gun configured to fire a projectile, comprising:

multiple cylinders storing gas at high pressure;

a barrel having a first end and a second end;

a pre-chamber storage vessel aligned with a bore axis of the barrel in fluid communication with the multiple cylinders;

an annular slot sleeve valve comprising a first body portion, a second body portion, a sleeve slidably engaged about the second body portion, a first valve seat between the sleeve and the first body portion, and a second valve seat between the sleeve and the second body portion, wherein:

the sleeve is configured to slide along the second body portion from a closed-valve position where the sleeve is seated upon both the first and second valve seats to an open-valve position where the sleeve is unseated from each of the first and second valve seats, and the sleeve valve is in fluid communication with the pre-chamber storage vessel and configured to mechanically control the flow of gas from the pre-chamber storage vessel;

a De Laval nozzle immediately adjacent the sleeve valve and upstream of the barrel, wherein the nozzle is shaped to accelerate the gas to supersonic velocity across an axial length of the nozzle;

the first end of the barrel being disposed adjacent to the nozzle such that the first end of the barrel abuts an opening of the nozzle; and a mechanical control mechanism configured to mechanically open the sleeve valve upon actuation of the control mechanism, wherein the sleeve valve is configured to remain open until a projectile exits the barrel.

9. The pneumatic gun of claim 8, wherein the first end of the barrel is configured to receive a pressure release projectile system including a case configured to receive a bullet, the case having a burst disk configured to withstand 90% of a target threshold pressure such that the case maintains a position of the bullet until 90% of the threshold pressure has been achieved in the De Laval nozzle.

10. A pneumatic gun configured to fire a projectile, comprising:

multiple-cylinder gas storage system configured to store gas at high pressure;

a barrel having a first end and a second end;

a pre-chamber storage vessel aligned with a bore axis of the barrel in fluid communication with the multiple-cylinder gas storage system;

an annular slot sleeve valve comprising a first body portion, a second body portion, a sleeve slidably engaged about the second body portion, a first valve seat between the sleeve and the first body portion, and a second valve seat between the sleeve and the second body portion, wherein:

the sleeve is configured to slide along the second body portion from a closed-valve position, where the sleeve is seated upon both the first and second valve seats, to an open-valve position, where the sleeve is unseated from each of the first and second valve seats, and the sleeve valve is in fluid communication with the pre-chamber storage vessel and configured to mechanically control the flow of gas from the pre-chamber storage vessel;

a De Laval nozzle immediately adjacent the sleeve valve and upstream of the barrel, wherein the nozzle is shaped to accelerate the gas to supersonic velocity across an axial length of the nozzle;

the first end of the barrel being disposed adjacent to the nozzle such that the first end of the barrel abuts an opening of the nozzle; and a mechanical trigger configured to mechanically open the sleeve valve upon actuation of the trigger, wherein the sleeve valve is configured to remain open until at least a portion of a projectile exits the barrel.

11. The pneumatic gun of claim 10, wherein a volume of the pre-chamber storage vessel is at least ten times greater than a bore volume of the barrel.

12. The pneumatic gun of claim 10, wherein the gas comprises a gas mixture including helium, hydrogen, and a gaseous fire retardant.

13. The pneumatic gun of claim 12, wherein the gas mixture further includes a lubricant.

* * * * *